United States Patent [19]

Eftink

[11] Patent Number: 4,998,525

[45] Date of Patent: Mar. 12, 1991

[54] AIR SUPPLY SYSTEM FOR AN INTERNAL COMBUSTION ENGINE

[76] Inventor: Aloysius J. Eftink, 7103 Bonnie Mill La., Springfield, Va. 22150

[21] Appl. No.: 364,318

[22] Filed: Jun. 12, 1989

[51] Int. Cl.[5] ..... F02B 33/36

[52] U.S. Cl. ..... 123/559.1; 123/65 B; 123/560

[58] Field of Search ..... 123/559.1, 560, 65 B, 123/68

[56] References Cited

U.S. PATENT DOCUMENTS

| | | | |
|---|---|---|---|
| 1,160,419 | 11/1915 | Lawrence . | |
| 1,677,305 | 7/1928 | Sperry . | |
| 2,087,619 | 7/1937 | Howard | 123/65 |
| 2,874,534 | 2/1959 | Canazzi | 60/31 |
| 3,517,652 | 6/1970 | Albertson | 123/65 |
| 3,688,749 | 9/1972 | Wankel | 418/54 X |
| 3,866,581 | 2/1975 | Herbert | 123/51 B |
| 3,903,854 | 9/1975 | Shelton | 123/65 B |
| 4,069,794 | 1/1978 | Jordan | 123/25 A |
| 4,399,778 | 8/1983 | Ancheta | 123/65 VB |
| 4,527,520 | 7/1985 | Koch | 123/196 R |
| 4,566,422 | 1/1986 | Tadokoro et al. | 123/559 |
| 4,674,462 | 6/1987 | Koch et al. | 123/533 |
| 4,766,729 | 8/1988 | Miyajima | 123/559.1 X |
| 4,843,821 | 7/1989 | Paul et al. | 123/559.1 X |

FOREIGN PATENT DOCUMENTS

| | | | |
|---|---|---|---|
| 749797 | 5/1933 | France | 123/68 |
| 51221 | 3/1983 | Japan . | |
| 93923 | 5/1984 | Japan . | |

*Primary Examiner*—Michael Koczo
*Attorney, Agent, or Firm*—Bacon & Thomas

[57] ABSTRACT

The present invention describes a system for supplying the primary combustion air to a reciprocating piston internal combustion engine including a trochoidal chamber air pump having a pair of pumping chambers interposed between an air intake and each of the cylinders of the engine. Each pumping chamber has an air inlet connected to an air intake, and an air outlet that is connected to the cylinders. In a two-cycle mode of operation, each pumping chamber outlet is connected to one engine cylinder. In a four-cycle mode of operation, each pumping chamber outlet is connected to a pair of cylinders to supply air during the intake stroke. The input shaft of the trochoidal chamber air pump is driven by, and may be connected directly to, the crankshaft of the engine so as to rotate on a 1:1 ratio.

28 Claims, 7 Drawing Sheets

AIR SUPPLY SYSTEM FOR AN INTERNAL COMBUSTION ENGINE

BACKGROUND OF THE INVENTION

Reciprocating piston internal combustion engines are well known in the art and typically operate in either a two cycle or a four cycle mode. In a two-cycle mode of operation, each downward stroke of the piston supplies power to a rotating crank shaft. During the downward stroke, burned gases are exhausted and fresh fuel and air are drawn into the combustion chamber. As the piston subsequently moves upwardly in the cylinder, the exhaust port is closed and the fresh fuel/air mixture is compressed and ignited.

In a four-cycle mode of operation, each piston delivers power to the crank shaft every two strokes. The explosion of the fuel/air mixture in the combustion chamber forces the piston downwardly to deliver power to the crankshaft. As the piston passes bottom dead center and begins to rise in the cylinder, the burned gases are forced out through an exhaust valve or port. After passing top dead center, the downward movement of the piston draws a fresh charge of fuel/air into the cylinder which is compressed and ignited during the following upward stroke of the piston.

The increasingly stringent requirements regarding exhaust emissions of internal combustion engines have necessitated the use of means to precisely meter the amount of fuel and the amount of air mixed in the combustion chamber to achieve a fuel/air ratio as close to stoichiometric as possible. Fuel injection systems have virtually replaced the carburetor, since they are capable of more precisely metering the amount of fuel entering the combustion chamber.

It is known to utilize pressurized air to mix with the fuel in the combustion chamber. The air may be either from a reservoir of compressed air, or may be pressurized by use of a turbocharger or supercharger. The turbocharger is a rotary impeller connected to a turbine that is driven by the exhaust gases from the engine. The supercharger usually comprises a rotary or screw-type air pump driven by a power take off from the engine crankshaft. Typically, the superchargers are vane-type compressors or screw-type compressors.

Although, these systems have proven generally satisfactory, the use of turbochargers or superchargers has increased the complexity of the typical internal combustion engine to the point where its reliability is inherently compromised.

Additionally, in a turbocharger there is a certain amount of time lag between the opening of the throttle valve and the delivery of pressurized air to the combustion chamber. This is caused by the amount of time it takes the exhaust gases to increase the rotation of the turbine/impeller to pressurize the incoming air.

The supercharger, since it is driven through a mechanical connection to the crankshaft does not suffer from "turbo lag". However, the drive systems for superchargers, usually belt drives, increase the complexity of the engine and do not provide a mechanically foolproof interconnection between the crankshaft and supercharger.

SUMMARY OF THE INVENTION

The present invention relates to a system for supplying the primary combustion air to a reciprocating piston internal combustion engine that is simpler and more reliable than the known systems. A trochoidal chamber air pump having a pair of pumping chambers is interposed between an adjustable air intake and each of the cylinders of the engine. Each pumping chamber has an air inlet connected to an adjustable air intake, and an air outlet that is connected to the cylinders. In a two-cycle mode of operation, each pumping chamber outlet is connected to one engine cylinder. Thus, the number of pumping chambers is equal to the number of engine cylinders. In a four-cycle mode of operation, each pumping chamber outlet is connected to a pair of cylinders.

The pump shaft of the trochoidal chamber air pump is driven by, and may be connected directly to, the crankshaft of the engine such that they rotate on a 1:1 ratio. The displacement volume of each pumping chamber may be equal to or greater than the displacement volumes of each cylinder plus the volume of interconnecting conduits. If the displacement volume of the chamber is greater, the air pump will act as a supercharger when the throttle valve is sufficiently opened.

DETAILED DESCRIPTION OF THE PREFERRED EMBODIMENT

Figure 1:
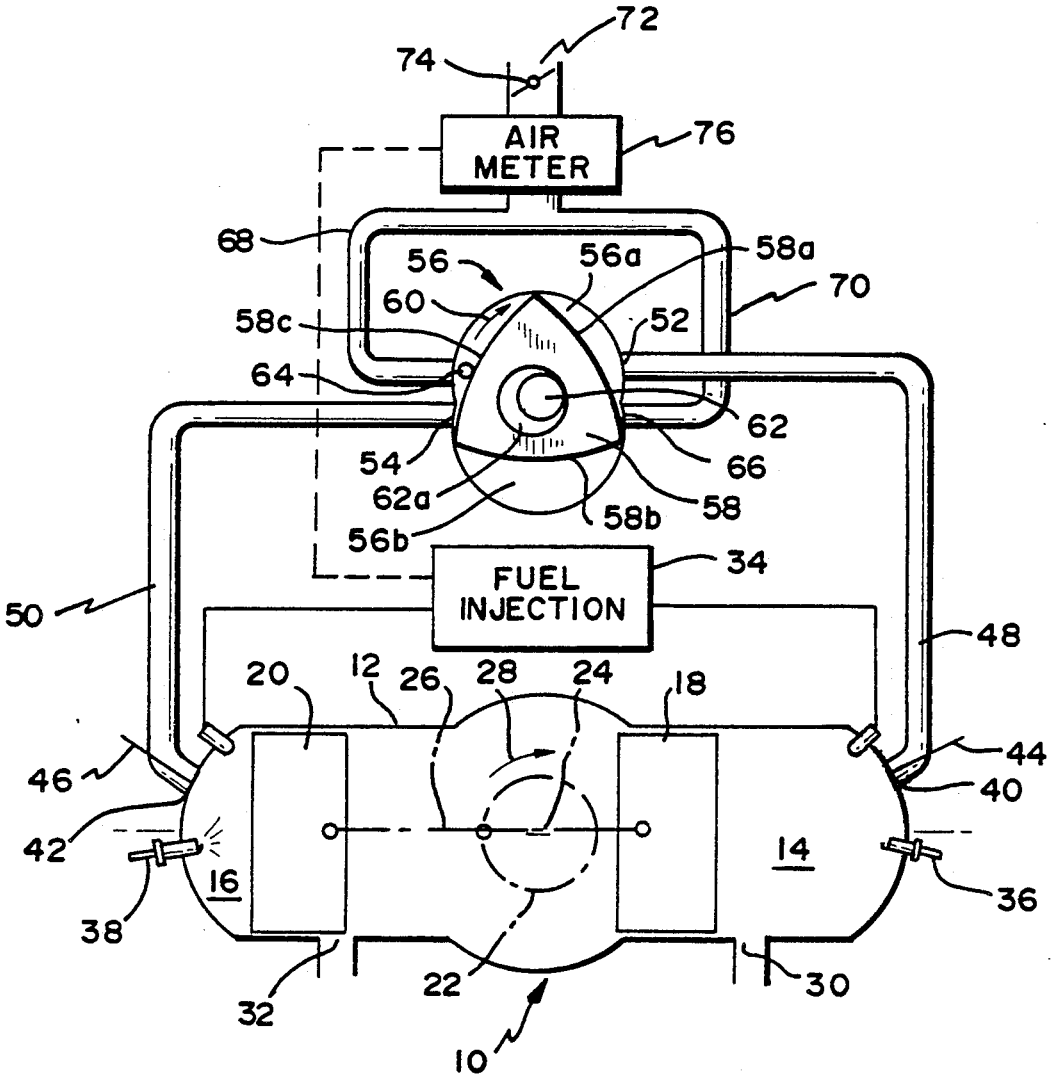
FIGS. 1–4 are schematic diagrams showing the operational sequence of a two-cylinder, two-cycle engine incorporating the air intake system according to the invention.

The operation of the invention will be explained in reference to FIGS. 1–4 illustrating a horizontally opposed, two-cylinder, two-cycle internal combustion engine. However, it should be understood that the principles explained in reference to these figures are equally applicable to either two or four-cycle engines, as well as engines operating on a Diesel cycle, having any number of cylinders arranged in any orientation. Engine 10 has an engine block or casing 12 that defines a pair of cylinders 14 and 16. Although engine block 12 is illustrated as being of the horizontally opposed type, other engine types, such as in-line or V-type can be utilized without exceeding the scope of this invention.

Pistons 18 and 20 are slidably received in cylinders 14 and 16, respectively, and are connected to crankshaft 22 by connecting rods 24 and 26 in known fashion. Crankshaft 22 rotates in a clockwise direction as indicated by arrow 28 in FIGS. 1–4.

Cylinders 14 and 16 are provided with exhaust ports 30 and 32 as well as fuel injection means 34 to supply a specified amount of fuel to each of the cylinders. Exhaust ports 30 and 32 could be replaced by exhaust valves actuated by known mechanisms without exceeding the scope of the invention. Ignition means, such as spark plugs 36 and 38 are provided for each of the cylinders to ignite the fuel/air mixture therein. Fuel injection system 34 may be any known mechanical or electronic type system and, per se, forms no part of the instant invention. A carburetor could be substituted for the fuel injection system if desired.

Cylinders 14 and 16 also have air intake ports 40 and 42, the opening and closing of which are controlled by valves 44 and 46, respectively. The actuation of valves 44 and 46 is by known means, which may include cam shafts and push rods driven from the crankshaft 22, as is well known in the art.

Air intake ports 40 and 42 communicate with intake conduits 48 and 50 which are, in turn, connected to the air outlets 52 and 54 (which are peripheral ports) of pumping chambers 56*a* and 56*b* of trochoidal chamber air pump 56. As is well known in the art, the trochoidal chamber air pump 56 has rotor 58 mounted therein so as to rotate in the direction of arrow 60. Rotor 58 rotates around a stationary gear on the pump housing as is well known in the art and is driven by pump shaft 62 via the engagement of eccentric portion 62*a* with the central opening in rotor 58 in known fashion such that rotation of shaft 62 causes the rotor 58 to rotate in the direction of arrow 60. Chambers 56*a* and 56*b* have air inlet ports 64 and 66 (which are side ports) connected to air inlet conduits 68 and 70, respectively. A Wankel-type air pump is illustrated and described, but other types of air pumps could also be utilized without exceeding the scope of this invention.

Inlet conduits 68 and 70 are connected to air inlet 72 which directs ambient air into the system. Variable throttle valve 74 may be mounted in the air inlet 72 upstream of air pump 56 and be controlled by the operator of the engine in known fashion to vary the amount of air passing through the air inlet. An air meter 76 may also be located in the air inlet 72 downstream of the throttle valve 74 to detect the amount of air passing through the inlet and to control the fuel injection system 34 accordingly. Such air meters and their interconnections with fuel injection systems are believed to be well known in the art and, suffice to say, that any such known system may be utilized with the present invention.

In the positions of the components shown in FIG. 1, piston 20 is at its top dead center (TDC) position while piston 18 is at bottom dead center (BDC). The compressed fuel/air mixture in cylinder 16 has just been ignited by spark plug 38. The expansion of the gases will force piston 20 to the right as seen in FIG. 1, to rotate the crankshaft in the direction of arrow 28. Both intake valves 44 and 46 are closed.

Pump shaft 62 is connected to crankshaft 22 so as to rotate therewith in a ratio approximately 1:1. Rotation of shaft 62 causes the rotor 58 to rotate in the direction of arrow 60 through the engagement of eccentric portion 62*a* with the central opening in rotor 58 as is well known in the art. The connection is such that rotor 58 rotates one-third of a revolution for each full revolution of shaft 62. The corners of rotor 58 seal against the interior of pump chambers 56*a* and 56*b* as rotor 58 rotates. Face 58*a* of rotor 58 pressurizes the air in chamber 56*a* as it moves toward outlet 52. Since valve 44 is closed at this point, the air in pumping chamber 56*a* will be pressurized and will fill the intake conduit 48. The volume ($V_3$) of each of the pumping chambers 56*a* and 56*b* is at least equal to the volume ($V_2$) of each of the air intake conduits 48 and 50 plus the displacement volume ($V_1$) of each of the cylinders 14 and 16. The volumes of air intake conduits 48 and 50 are approximately equal. If a supercharging effect is desired, the volume $V_3$ of the pumping chambers may be 40% to 50% greater than the volumes $V_1$ plus $V_2$.

Figure 2:
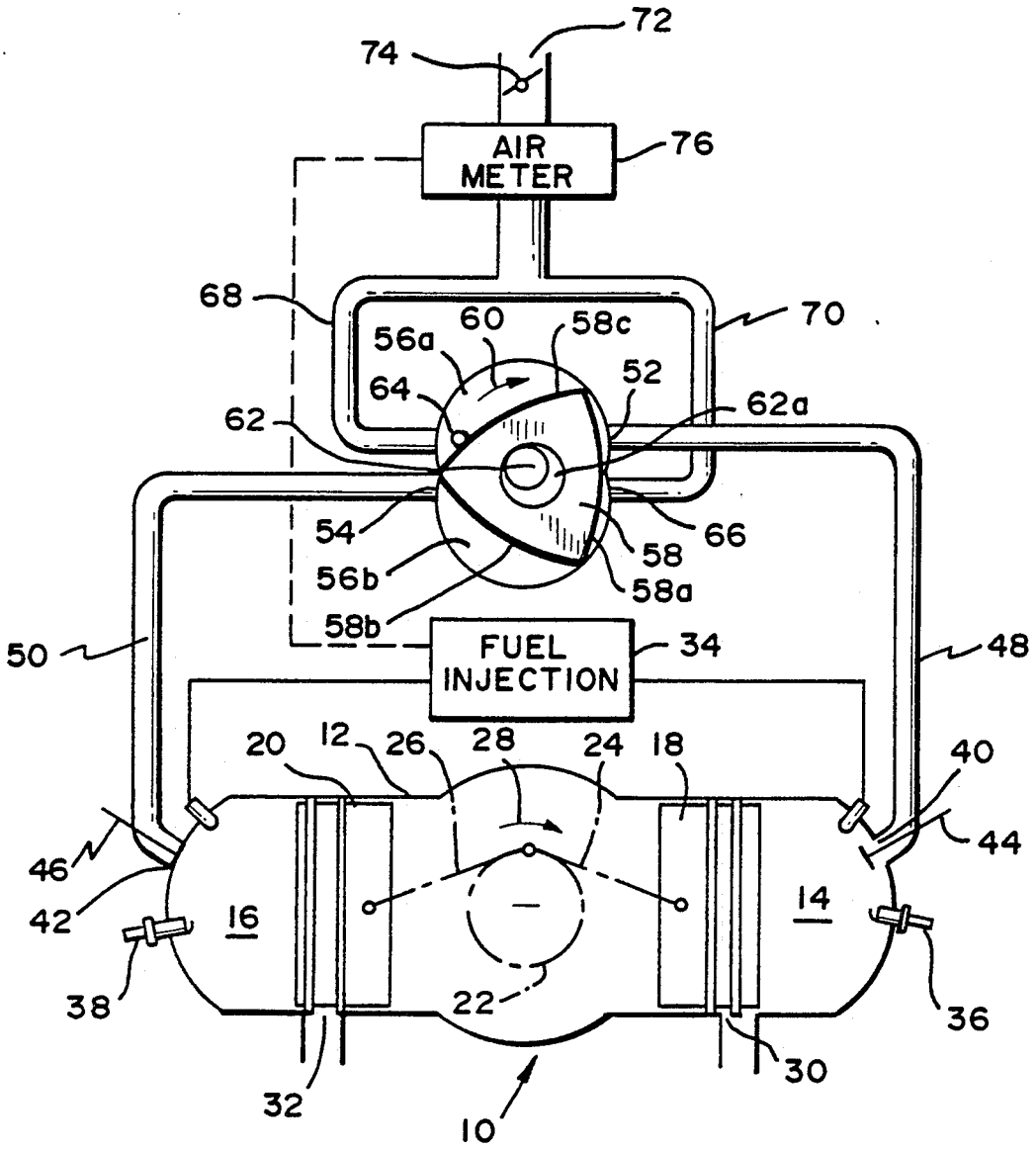

In the positions shown in FIG. 2, crankshaft 22 has rotated 90° from the position in FIG. 1 and piston 18 has closed off exhaust port 30. Since exhaust port 32 is still closed by piston 20, the expanding gases in cylinder 16 continue to exert a power force on piston 20. Face 58*a* of rotor 58 has pressurized the air in pumping chamber 56*a* and intake conduit 48. At this point, intake valve 44 has opened, allowing the pressurized air to enter the combustion chamber of cylinder 14. Fuel injection system 34 may, at this point inject a specified amount of fuel into the cylinder 14 so as to mix with the incoming air.

Also at this point, face 58*b* of rotor 58 has completed the intake portion of its stroke through air inlet 66 and begins to pressurize the air in pumping chamber 56*b* and intake conduit 50. This air is prevented from entering combustion chamber of cylinder 16 by the closure of intake valve 46.

Figure 3:
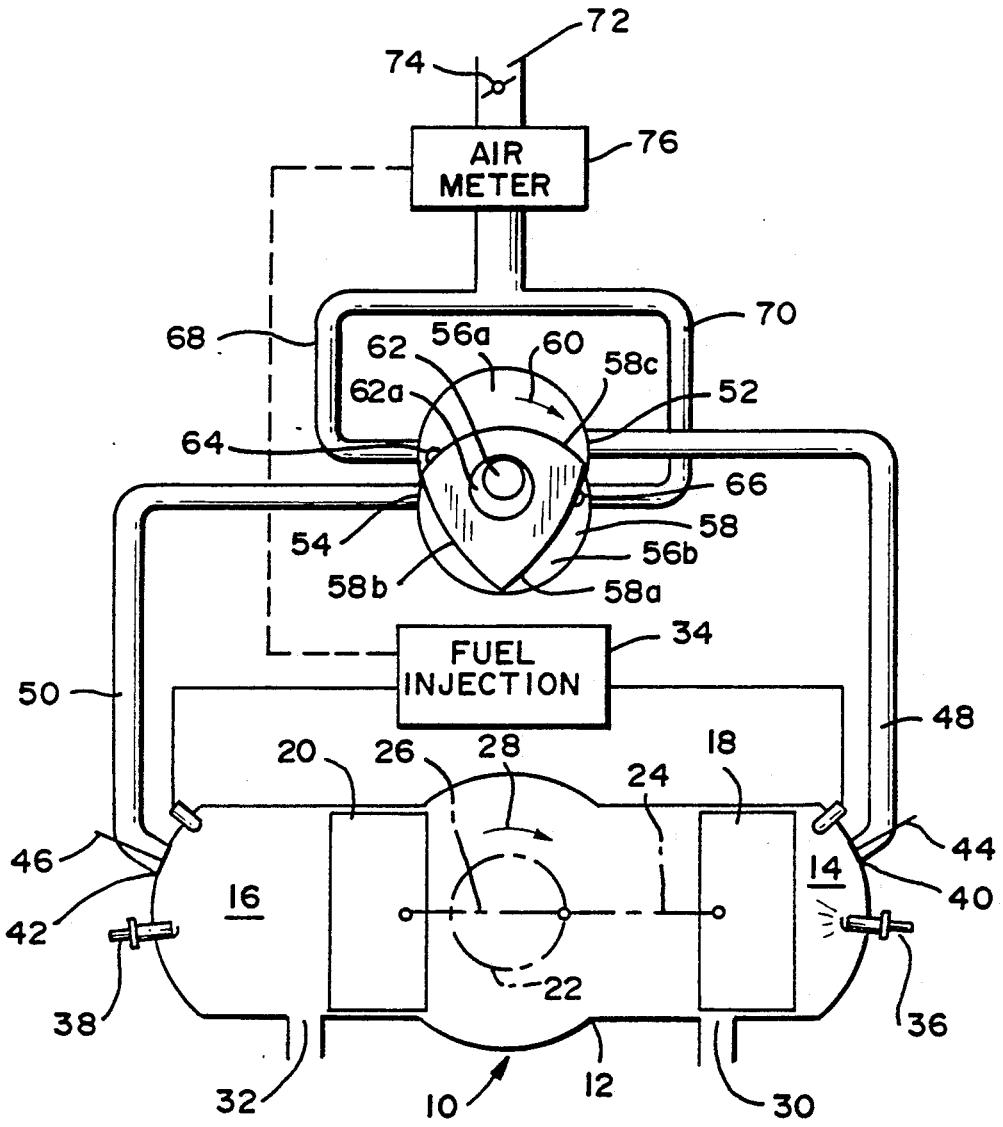

In FIG. 3, piston 18 has reached is top dead center (TDC) position and further compressed the fuel/air mixture in the combustion chamber of cylinder 14. Spark plug 36 may be fired at this point so as to ignite the compressed fuel/air mixture. Although the timing of the firing of the spark plugs has been illustrated as occuring at top dead center position, it is to be understood that this firing may take place either before or after such top dead center position as is well known in the art. Piston 20 has reached bottom dead center (BDC) and uncovered exhaust port 32 allowing the burned gases in the combustion chamber of cylinder 16 to be exhausted. Face 58*a* of rotor 58 has just passed the air outlet 52, while face 58*b* continues to pressurize the air in pumping chamber 56*b* and intake conduit 50.

Figure 4:
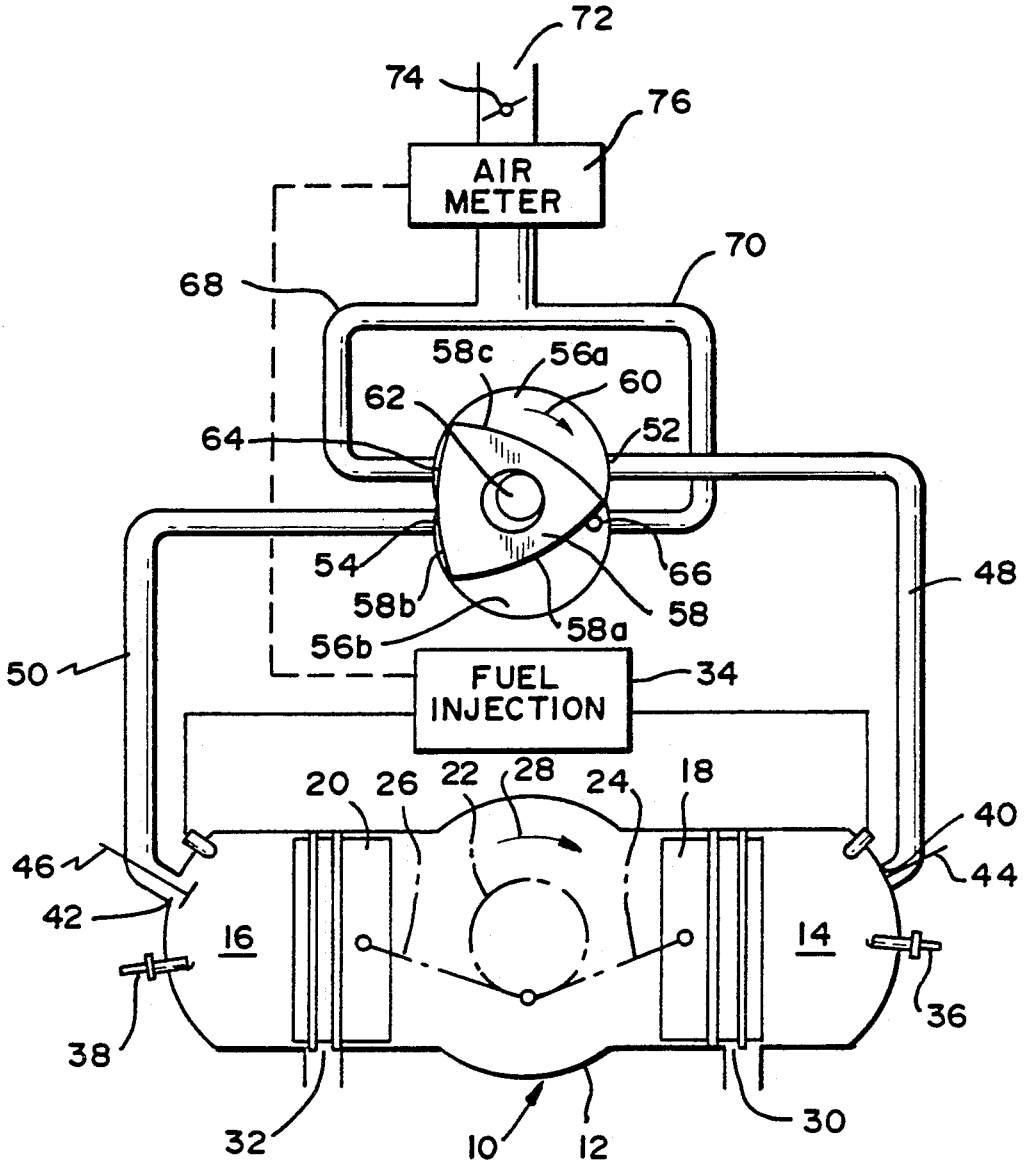

In the position shown in FIG. 4, the expanding gases in the combustion chamber of cylinder 14 urge the piston 18 toward the left in its power stroke. At this point, valve 44 has closed and exhaust port 30 has not yet been opened by piston 18. In cyclinder 16, piston 20 has closed the exhaust port 32 and valve 46 has opened to allow the air from intake conduit 50 and pumping chamber 56*b* to enter the cylinder 16. It is to be understood, however, that valve 46 may be opened slightly before exhaust port 32 has been completely closed by piston 20 in order to assist in the scavenging of the burned gases from the combustion chamber of this cylinder. Fuel, however, is not injected until after exhaust port 32 has been closed to prevent raw fuel from mixing with the exhaust gases.

At this point, face 58*c* of rotor 58 begins pressurizing the air in pumping chamber 56*a* for the next upward stroke of piston 18 while face 58*b* completes the expulsion of air from pumping chamber 56*b* through outlet port 54.

The next 90° rotation of crankshaft 22 results in the elements assuming the positions shown in FIG. 1, with the exception that rotor 58 has rotated one-third of a revolution. Thus, face 58*c* is now in the position of face 58*a* in FIG. 1 and the cycle repeats as previously described.

In a practical application of the present invention, the trochoidal chamber air pump 56 may be attached directly to the engine block or housing 12 such that the axis of pump shaft 62 is coaxial with the rotational axis of crankshaft 22. The pump shaft 62 may be formed as an extension of the crankshaft 22 such that the rotor 58 is driven directly by the crankshaft. This feature is illustrated in FIGS. 5–7 for various types of internal combustion engines.

Figure 5:
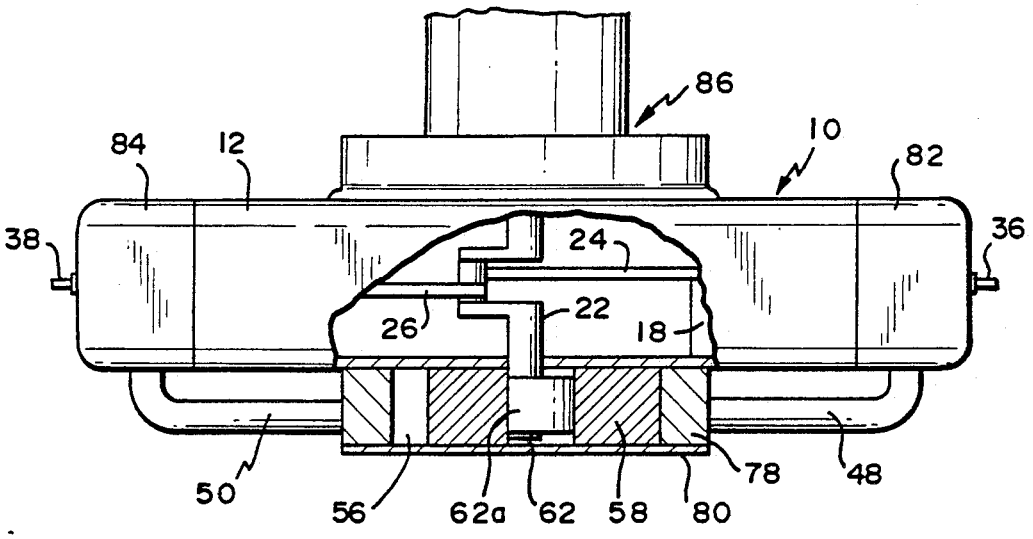
FIG. 5 is a top plan view, partially broken away, illustrating a two-cylinder, two-cycle engine incorporating the air intake pump according to the invention.

In FIG. 5, a single rotor pump 56 is illustrated in connection with a two-cylinder, two-cycle reciprocating piston internal combustion engine. The operation details of the engine, such as fuel injection system, air intake, ignition system, etc. have been deleted for the purposes of clarity. It can be appreciated, however, that any such known systems may be utilized in conjunction with this invention. As shown in this figure, pump shaft 62 is formed as an extension of crankshaft 22 extending beyond the boundaries of engine casing or block 12. The trochoidal chambers 56*a* and 56*b* are defined by pump housing 78 attached directly to the engine block or casing 12. End plate 80 is attached to the distal sides of pump housing 78 to define the side boundaries of the pumping chambers 56*a* and 56*b*. Sealing between the sides of rotor 58, the engine block 12 and the end plate 80 is achieved by known means, the details of which form no part of the present invention. Air intake conduits 48 and 50 direct air from the pumping chambers 56*a* and 56*b* into cylinder heads 82 and 84, and through the respective intake valves. The output end of crankshaft 22 may be connected to power transmission means 86 or the like.

Figure 6A:
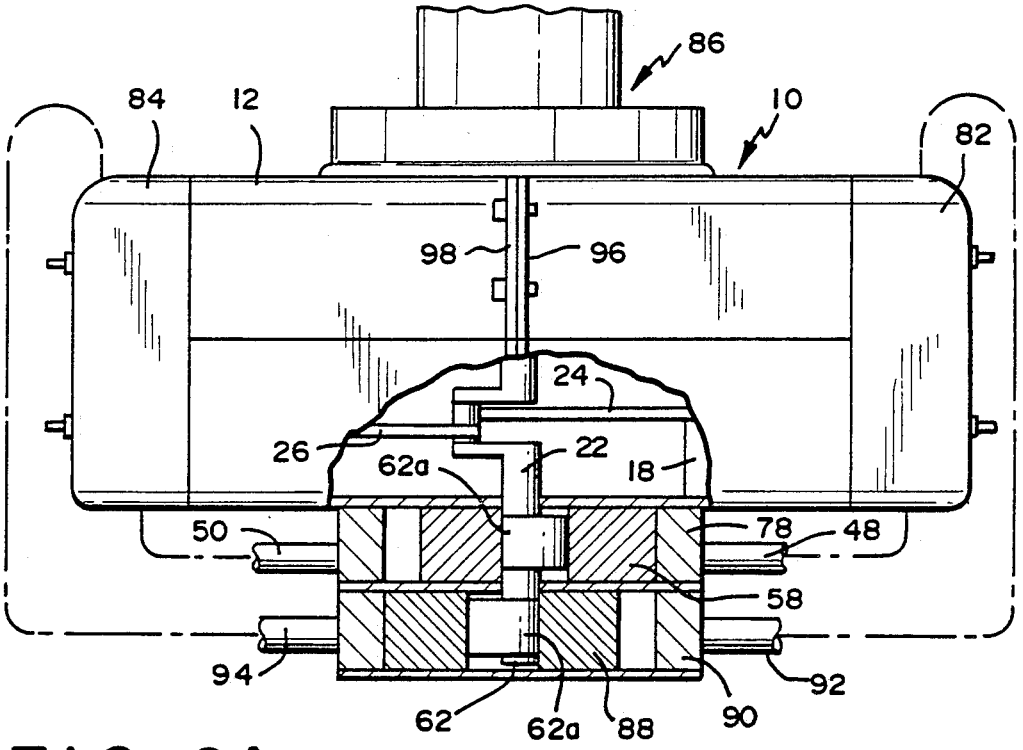
FIGS. 6A and 6B are top plan views, partially broken away, illustrating the air intake system according to the invention utilized with a four-cylinder, two-cycle engine.
Figure 6B:
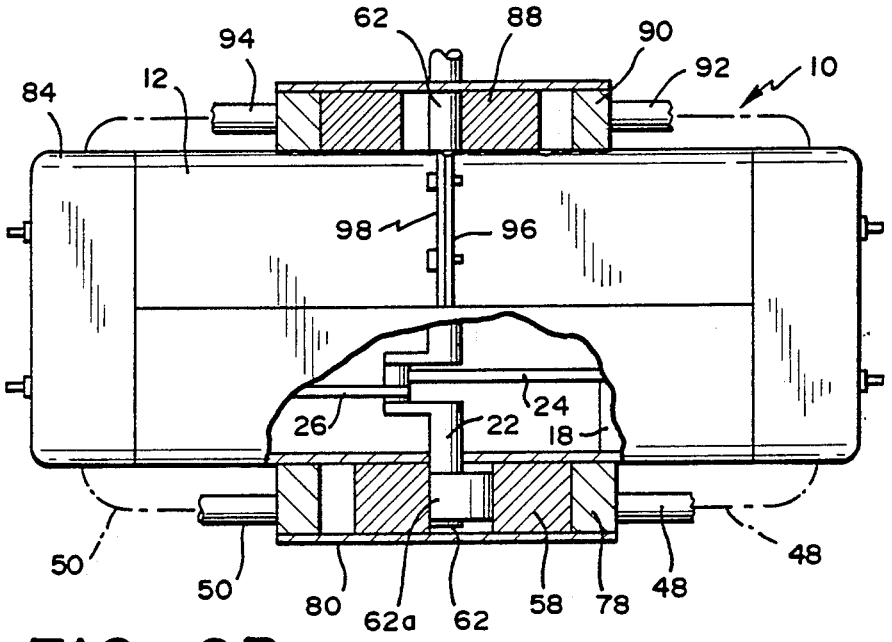

FIGS. 6A and 6B are views similar to the view shown in FIG. 5, but illustrate a four-cylinder, two-cycle engine. Since, in the two-cycle mode, the number of pumping chambers must be equal to the number of cylinders, a two-rotor trochoidal chamber air pump is utilized. Again, the pump shaft 62 is formed as an extension of the crankshaft 22 and drivingly engages pump rotors 58 and 88 in pump housings 78 and 90, respectively. Pump housing 78 defines the air outlets connected to intake conduits 48 and 50 as previously described to supply air to two of the four cylinders. Pump housing 90 defines additional air outlets connected to intake conduits 92 and 94, respectively, to supply air to the remaining two cylinders through cylinder heads 82 and 84.

Figure 7:
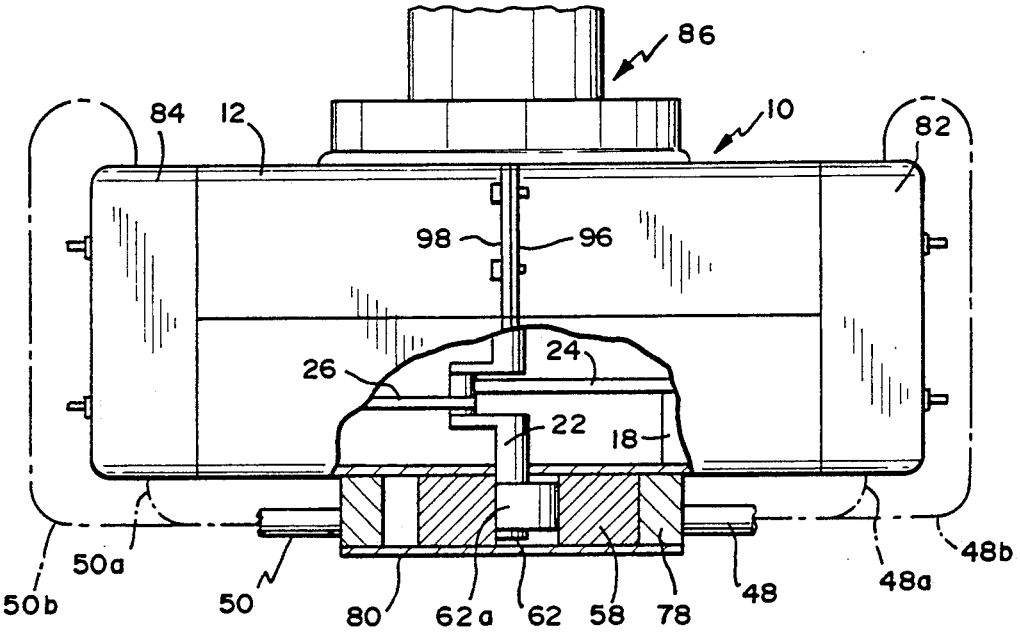
FIG. 7 is a top plan view, partially broken away, illustrating the air-intake system according to the invention utilized with a four-cylinder, four-cycle engine.
Figure 8:
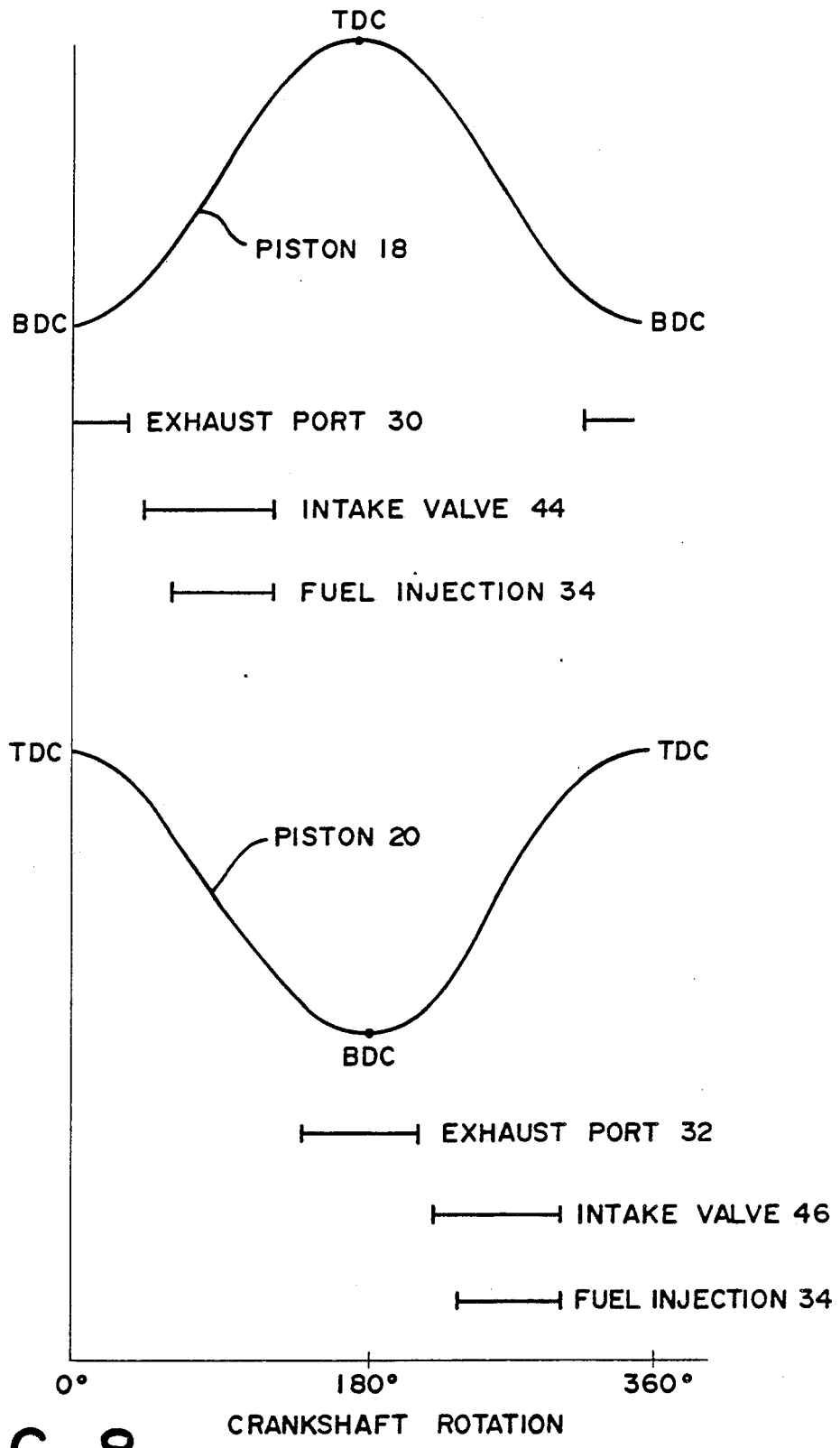
FIG. 8 is a timing chart illustrating the positions of the engine components relative to the crankshaft rotation.

FIG. 7 illustrates the invention used in a four-cylinder, four-cycle engine. The four-cycle, four cylinder engine requires only a single rotor trochoidal chamber air pump which is, again, driven by pump shaft 62 formed as an extension of crankshaft 22. The air intake conduits 48 and 50 each supply air to a pair of cylinders. The conduits may branch off into intake conduits 48*a* and 48*b* as well as 50*a* and 50*b*, each delivering intake air to one cylinder. Since each piston of the four-cycle engine has a power stroke only on every alternate stroke, the number of pumping chambers in the air pump need only be one-half the number of cylinders of the engine.

It is envisioned that the engine casing or block 12 may be formed in identical halves divided along a generally vertical plane passing through the rotational axis of the crankshaft and be joined together at flanges 96 and 98 formed on each of the halves. This will facilitate the manufacture of a horizontally opposed type engine, since the halves of the engine may be identical.

The foregoing description is provided for illustrative purposes only and should not be construed as in any way limiting this invention, the scope of which is defined solely by the appended claims.

What is claimed is:

1. In a reciprocating piston internal combustion engine having a crankshaft and at least two cylinders, each cylinder having a displacement volume $V_1$, the improved means for supplying air to each cylinder comprising:

(a) a rotary, trochoidal chamber air pump defining at least one pair of pumping chambers, the number of pumping chambers being equal to the number of cylinders in the engine;

(b) air intake conduits connecting each pumping chamber to one cylinder of the engine;

(c) a rotor rotatable in each pair of pumping chambers, the rotor having three faces such that passage of a face of the rotor through a pumping chamber forces air in the pumping chamber into the associated air intake conduit and, consequently, into the engine cylinder; and, (d) means interconnecting the rotor and the crankshaft so as to rotate the rotor approximately one revolution for every three revolutions of the crankshaft.

2. The improved internal combustion engine according to claim 1 wherein the means to rotate the rotor comprises:

(a) a pump shaft drivingly connected to the rotor such that rotation of the pump shaft causes rotation of the rotor; and, (b) drive means interconnecting the crankshaft and the pump shaft such that rotation of the crankshaft causes rotation of the pump shaft.

3. The improved internal combustion engine according to claim 2 wherein the drive ratio between the crankshaft and the pump shaft is approximately 1:1.

4. The improved internal combustion engine according to claim 3 wherein the pump shaft has an axis of rotation coincident with an axis of crankshaft rotation.

5. The improved internal combustion engine according to claim 4 wherein the pump shaft is formed as an extension of the crankshaft.

6. The improved internal combustion engine according to claim 1 wherein each air intake conduit connecting a pumping chamber with an engine cylinder has a volume $V_2$ and each pumping chamber has a displacement volume $V_3$ such that $$V_3 \geqq (V_1 + V_2).$$

7. The improved internal combustion engine according to claim 6 wherein the ratio $V_3/(V_1+V_2)$ is between 1 and approximately 1.5.

8. The improved internal combustion engine according to claim 1 further comprising:

(a) air inlet conduit means communicating with the pumping chambers to direct ambient air into each pumping chamber; and, (b) throttle valve means located in the air inlet conduit upstream of the pumping chambers.

9. The improved internal combustion engine according to claim 8 wherein the means to rotate the rotor comprises:

(a) a pump shaft drivingly connected to the rotor such that rotation of the pump shaft causes rotation of the rotor; and (b) drive means interconnecting the crankshaft and the pump shaft such that rotation of the crankshaft causes rotation of the pump shaft.

10. The improved internal combustion engine according to claim 9 wherein each conduit means connecting the pumping chamber with the cylinders has a volume $V_2$ and each pumping chamber has a displacement volume $V_3$ such that $$V_3 \geqq (V_1+V_2).$$

11. The improved internal combustion engine according to claim 10 wherein the ratio $V_3/(V_1+V_2)$ is between 1 and approximately 1.5.

12. The improved internal combustion engine according to claim 11 wherein the drive ratio between the crankshaft and the pump shaft is approximately 1:1.

13. The improved internal combustion engine according to claim 12 wherein the pump shaft has an axis of rotation coincident with an axis of crankshaft rotation.

14. The improved internal combustion engine according to claim 13 wherein the pump shaft is formed as an extension of the crankshaft.

15. In a reciprocating piston internal combustion engine having a crankshaft and at least four cylinders, each cylinder having a displacement volume $V_1$, the improved means for supplying air to each cylinder comprising:

(a) a rotary, trochoidal chamber air pump defining at least one pair of pumping chambers, the number of pumping chambers being equal to one-half the number of engine cylinders;

(b) air intake conduits connecting each pumping chamber to a pair of engine cylinders;

(c) a rotor rotatable in each pair of pumping chambers, the rotor having three faces such that passage of a face of the rotor through a pumping chamber forces air in the pumping chamber into the associated air intake conduit and engine cylinder; and (d) means interconnecting the rotor and the crankshaft so as to rotate the rotor approximately one revolution for every three revolutions of the crankshaft.

16. The improved internal combustion engine according to claim 15 wherein the means to rotate the rotor comprises:

(a) a pump shaft drivingly connected to the rotor such that rotation of the pump shaft causes rotation of the rotor; and, (b) drive means interconnecting the crankshaft and the pump shaft such that rotation of the crankshaft causes rotation of the pump shaft.

17. The improved internal combustion engine according to claim 16 wherein the drive ratio between the crankshaft and the pump shaft is approximately 1:1.

18. The improved internal combustion engine according to claim 17 wherein the pump shaft has an axis of rotation coincident with an axis of crankshaft rotation.

19. The improved internal combustion engine according to claim 18 wherein the pump shaft is formed as an extension of the crankshaft.

20. The improved internal combustion engine according to claim 15 wherein each air intake conduit connecting a pumping chamber with an engine cylinder has a volume $V_2$ and each pumping chamber has a displacement volume $V_3$ such that $$V_3 \geqq (V_1+V_2).$$

21. The improved internal combustion engine according to claim 20 wherein the ratio $V_3/(V_1+V_2)$ is between 1 and approximately 1.5.

22. The improved internal combustion engine according to claim 15 further comprising:

(a) air inlet conduit means communicating with the pumping chambers to direct ambient air into each pumping chamber; and, (b) throttle valve means located in the air inlet conduit upstream of the pumping chambers.

23. The improved internal combustion engine according to claim 22 wherein the means to rotate the rotor comprises:

(a) a pump shaft drivingly connected to the rotor such that rotation of the pump shaft causes rotation of the rotor; and, (b) drive means interconnecting the crankshaft and the pump shaft such that rotation of the crankshaft causes rotation of the pump shaft.

24. The improved internal combustion engine according to claim 23 wherein each air intake conduit connecting a pumping chamber with an engine cylinder has a volume $V_2$ and each pumping chamber has a displacement volume $V_3$ such that $$V_3 \geqq (V_1+V_2).$$

25. The improved internal combustion engine according to claim 24 wherein the ratio $V_3/(V_1+V_2)$ is between 1 and approximately 1.5.

26. The improved internal combustion engine according to claim 25 wherein the drive ratio between the crankshaft and the pump shaft is approximately 1:1.

27. The improved internal combustion engine according to claim 26 wherein the pump shaft has an axis of rotation coincident with an axis of crankshaft rotation.

28. The improved internal combustion engine according to claim 28 wherein the pump shaft is formed as an extension of the crankshaft.

* * * * *